United States Patent [19]

Itou et al.

[11] Patent Number: 4,873,120

[45] Date of Patent: Oct. 10, 1989

[54] METHOD OF MANUFACTURING CATHODE-RAY TUBE

[75] Inventors: Takeo Itou, Fukaya; Hidemi Matsuda, Oomiya; Mamoru Yoshizako, Tokyo; Osamu Yagi, Kawasaki, all of Japan

[73] Assignees: Kabushiki Kaisha Toshiba, Kawasaki; Tama Chemicals Co., Ltd., Tokyo, both of Japan

[21] Appl. No.: 136,943

[22] Filed: Dec. 23, 1987

[30] Foreign Application Priority Data

Dec. 23, 1986 [JP] Japan ..... 61-305206

[51] Int. Cl.[4] ..... B05D 5/06

[52] U.S. Cl. ..... 427/64; 427/108; 427/165; 427/226

[58] Field of Search ..... 427/64, 165, 226, 108

[56] References Cited

U.S. PATENT DOCUMENTS

| | | | |
|---|---|---|---|
| 2,692,838 | 10/1954 | Thurber | 427/64 |
| 3,689,312 | 9/1972 | Long et al. | 427/64 |
| 4,272,588 | 6/1981 | Yoldas et al. | 427/165 |
| 4,294,950 | 10/1981 | Kato | 427/165 |
| 4,410,563 | 10/1983 | Richter et al. | 427/165 |
| 4,535,026 | 8/1985 | Yoldas et al. | 427/165 |
| 4,596,745 | 6/1986 | Chao | 427/165 |

FOREIGN PATENT DOCUMENTS

| | | | |
|---|---|---|---|
| 1421901 | 4/1971 | Fed. Rep. of Germany | 427/64 |
| 61-118932 | 6/1986 | Japan . | |
| 61-277901 | 12/1986 | Japan . | |

*Primary Examiner*—Janyce Bell

*Attorney, Agent, or Firm*—Cushman, Darby & Cushman

[57] ABSTRACT

According to the invention, an antistatic/anti-reflecting film of high adhesive strength can be formed easily by forming an $SiO_2$ film on a cathode-ray tube faceplate by means of a condensation reaction of polyalkyl siloxane consisting essentially of condensed alkyl silicates. As a result, the sintering conditions for forming an antistatic-/anti-reflecting film can be set adequately. The antistatic effect can be further enhanced, reflection of the external light can be decreased, and workability can be greatly improved.

1 Claim, 2 Drawing Sheets

METHOD OF MANUFACTURING CATHODE-RAY TUBE

BACKGROUND OF THE INVENTION

1. Field of the Invention

The present invention relates to a method of manufacturing a cathode-ray tube and, more particularly, to a method of forming a film having anti-reflecting and antistatic properties on the outer surface of a cathode-ray tube faceplate.

2. Description of the Prior Art

Various non-glare treatments are commonly used to decrease reflection of external light on the outer surface of a cathode-ray tube faceplate, thereby to diminish the adverse effects of the reflected light. In one of these non-glare treatments, an alcohol solution consisting of alcoholate of Si, $Si(OR)_4$ is spray-coated on the outer surface of the faceplate, thereby forming numerous fine projections thereon.

Japanese Patent Disclosure (Kokai) No. 61-118932 discloses a practical non-glare treatment in which the film formed by the spray-coating of an alcohol solution of $Si(OR)_4$ on the outer surface of a faceplate is sintered at 150° C. or less, thereby to endow the film with antistatic properties. Since the sintering temperature is relatively low, the adherence of the film to the faceplate may be reduced. To prevent this reduction of adherence, $NHO_3$ is added to the alcohol solution. The above non-glare treatment, in which the film is formed of an alcohol solution of $Si(OR)_4$, takes place in the manner shown below.

(1) Hydrolysis (generation of a silanol group)

$$\equiv Si-OR+H_2O \rightarrow \equiv Si-OH+ROH$$

(2) Condensation of a silanol group (generation of a siloxane bond)

$$\equiv Si-OH+RO-Si\equiv \rightarrow \equiv Si-O-Si\equiv +ROH$$

$$\equiv Si-OH+HO-Si\equiv \rightarrow \equiv Si-O-Si\equiv +H_2O$$

In the above reaction, the silanol group gives an antistatic effect to the film, and siloxane bond serves to increase the adhesion of the film to the faceplate. Reaction (2) is promoted when the film is heated.

As long as the film is moderately heated, the silanol group remains in the film, whereby the film is sufficiently antistatic. In this case, however, the adherence of the film to the faceplate is insufficient since the siloxane bonds in the film is small in number. On the other hand, when the film is overheated, it cannot be adequately antistatic. Although acid such as $HNO_3$ can promote reaction (1), thereby reducing the time required for the aging of the coated film, it cannot serve to increase the adherence of the film sufficiently.

SUMMARY OF THE INVENTION

It is an object of the present invention to provide a method of manufacturing a cathode-ray tube, wherein an anti-reflecting film having a sufficient antistatic effect is formed on, and strongly adhered to, a faceplate.

According to the present invention, there is provided a cathode-ray tube manufacturing method which comprises the steps of coating on a cathode-ray tube faceplate a solution containing a polyalkyl siloxane which is obtained by condensing alkyl silicate in an average range of a dimer to a hexamer, and condensing a polyalkyl siloxane, thereby forming an $SiO_2$ film on the faceplate.

A polyalkyl siloxane is a condensate of two or more alkyl silicate monomers represented by the following formula:

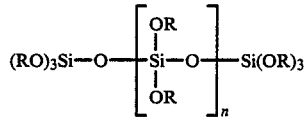

wherein R is an alkyl group (methyl, ethyl propyl, and butyl) and n=0, 1, 2, 3, . . .

Polyalkyl siloxane which is obtained by condensing alkyl silicate in an average range of a dimer to a hexamer is used for the following reasons. When alkyl silicate is condensed to a certain degree, e.g., in the range of a dimer to a hexamer, a film has a higher strength than that of polyalkyl siloxane containing non-condensed alkyl silicate monomers, as can be apparent from FIGS. 1 and 2 to be described later. When alkyl silicate is condensed into a hexamer or more, the resultant product tends to be easily gelled and is thus not practical. A low condensate cannot contain only the same type of oligomer, as in the case of a polymer. The low condensate usually contains alkyl silicates having different molecular weights. Even if alkyl silicates having different molecular weights in the range of a dimer to a hexamer are mixed, the effect of the present invention can be achieved.

As a major composition of the solution containing polyalkyl siloxane, an alcohol solution added with an acid or alkali and water, such as a normal alcoholate solution, is used in order to promote hydrolysis.

A methyl, ethyl, propyl, or butyl group can be used as an alkyl group in polyalkyl siloxane. However, a methyl or ethyl group is preferable since hydrolysis is facilitated.

The polyalkyl siloxane solution is coated on the surface of the faceplate of a cathode-ray tube by spraying, dispensing, or dipping. Sintering varies depending on the sintering time and temperature. At a temperature of about 100° C., the sintering time may be 10 to 15 minutes; about 200° C., 5 to 10 minutes; and 300° to 400° C., 5 minutes or less. In some cases, sintering is substantially unnecessary if an aging period of about a week is allowed (namely, if the coated faceplate can be exposed in air for about a week).

The silanol group formed by condensation according to the method of the present invention is obtained when a —OR group is hydrolyzed in the same manner as alkyl silicate of the conventional method described in Japanese Patent Disclosure (Kokai) No. 61-118932. The silanol group is partially condensed to form a siloxane bond. The condensation of the present invention is characterized in that a certain number of siloxane bonds are already contained in an alkyl siloxane solution which is to be coated on the faceplate and to be sintered or dried. Therefore, a film having a high adhesive force can be obtained even at an early stage of condensation of the silanol group. As a result, the present invention has the following two effects.

According to the first effect, the sintering conditions of the solution containing alkyl siloxane can be set adequately, such as a lower sintering temperature or sintering time shorter than in a conventional case, and a film having a sufficient adhesive force can be formed. As a result, labor and manufacturing facility can be decreased, thus providing an inexpensive cathode-ray tube easily.

For example, assume that a conventional faceplate having a film formed by spraying and a faceplate of the present invention having a film of the same thickness as the conventional one are compared. The relationship between the sintering time and the strength of the film is as shown in FIG. 1.

More specifically, in FIG. 1, the axis of ordinate represents the strength of the film and the axis of abscissa represents the time of sintering the film. The temperature is 115° C. and is constant. Note that the strength of the film is expressed by means of a maximum number of rubbing times with which the film is not damaged or removed by a rubbing test using an eraser with a load of 0.5 kg/cm$^2$. As is apparent from FIG. 1, with a load of 0.5 kg/cm$^2$. As is apparent from FIG. 1, in accordance with a conventional method, when sintering is performed for 30 minutes, the film is removed after rubbing was repeated about 15 to 20 times. In contrast to this, in accordance with the present invention, a film having a strength to endure rubbing of about 150 times can be obtained by sintering within 30 minutes. When sintering is performed for 1 hour, a film strength capable of enduring rubbing of 200 times or more can be obtained in accordance with the present invention, whereas a film strength capable of enduring rubbing as low as about 80 times can be obtained in accordance with the conventional method.

FIG. 2 shows a relationship between the sintering temperature and the strength of the film under the same experimental conditions as in the case of FIG. 1. In FIG. 2, the axis of ordinate represents the strength of the film and the axis of abscissa represents the sintering temperature. The sintering time is 10 minutes and is constant. As is apparent from FIG. 2, when the sintering temperature is 115° C., a strength capable of enduring rubbing of about 60 times can be obtained according to the present invention, whereas a strength capable of enduring rubbing of about 15 times can be obtained according to the conventional method.

In fine, according to the present invention, a film strength equal to or higher than the conventional film strength can be obtained with a sintering time of about 1/5 the conventional case provided that the temperature is constant. In other words, a film strength of equal to or higher than the conventinal film strength can be obtained with less strict sintering conditions.

The second effect of the present invention is to provide a sufficient antistatic effect. The antistatic effect is obtained by the silanol group. The parameters that influence the antistatic effect are: (1) the thickness of the film; and (2) the sintering conditions. The larger the film thickness and the weaker the sintering, the higher the antistatic effect. However, the adhering strength is inversely proportional to these parameters. In the present invention, since sufficient adhering strength can be maintained with less strict sintering conditions, i.e., the sintering time of about 1/5 the conventional case, the antistatic effect can be further enhanced.

DETAILED DESCRIPTION OF THE PREFERRED EMBODIMENTS

The present invention will be described by way of its examples.

EXAMPLE 1

A coating solution having the following composition was prepared.

| Composition | |
|---|---|
| polyalklyl siloxane (average degree of polymerization: tetramer) | 5 wt % |
| nitric acid | 3 wt % |
| water | 2 wt % |
| isopropyl alcohol | 90 wt % |

Figure 1:
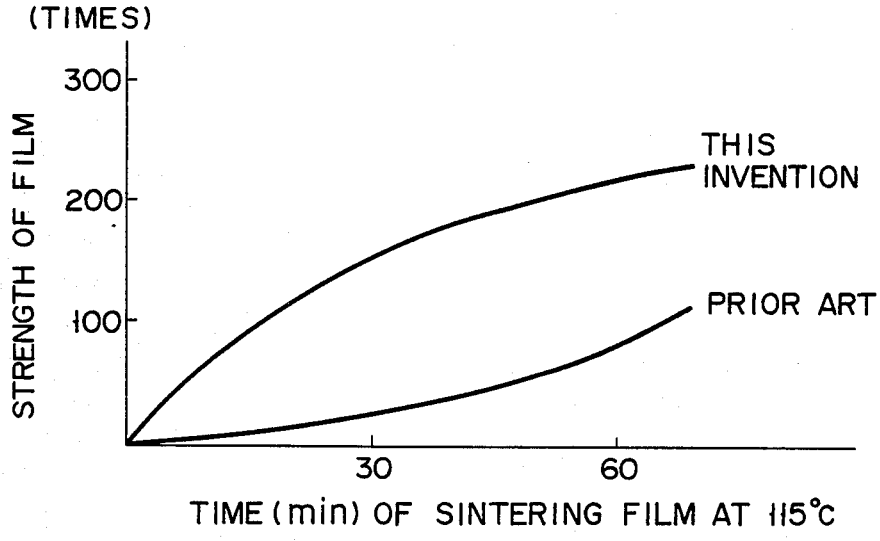
FIG. 1 is a graph showing a relationship between the strength of the film and the time of sintering the film.
Figure 2:
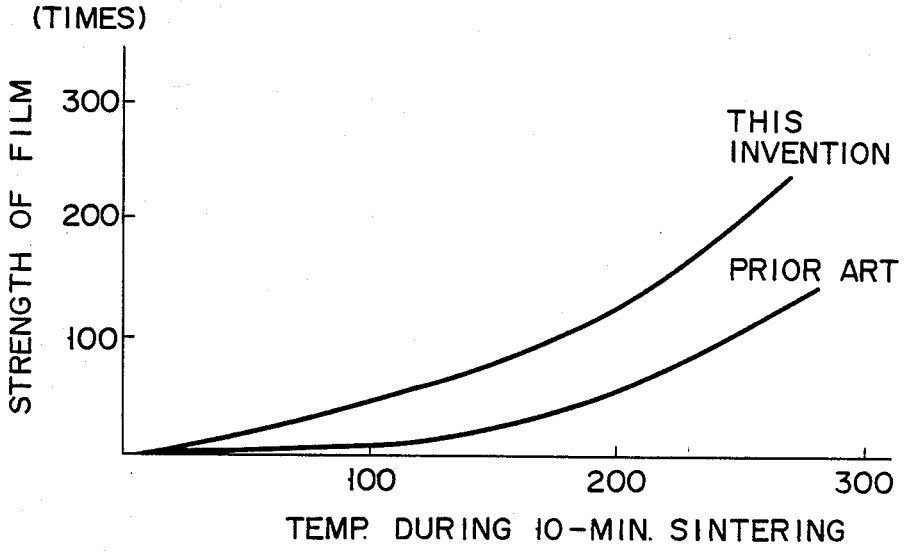
FIG. 2 is a graph showing a relationship between the strength of the film and the temperature during sintering.
Figure 3:
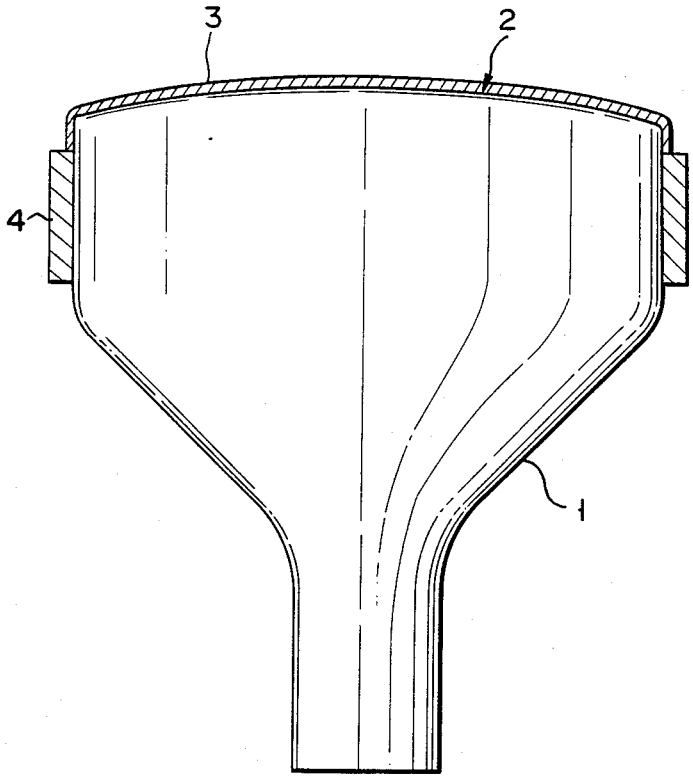
FIG. 3 is a view for explaining the structure of a color cathode-ray tube used in Example 1 of the present invention.

The solution was coated on outer surface 2 of the faceplate of color cathode-ray tube 1 shown in FIG. 3 by spraying. Cathode-ray tube 1 was sintered in a sintering furnace at a temperature of 115° C. for 10 minutes to form an antistatic/anti-reflecting film 3 having projections of average thickness of 0.7 μm on a outer surface 2 of the faceplate. Note that reference numeral 4 in FIG. 3 denotes an explosion-proof band.

Subsequently, resultant tube 1 was mounted in a television receiver in a room at a temperature of 20° C. and a humidity of 40%. The surface of the faceplate was not charged and the antistatic effect was thus confirmed. When tube 1 was subjected to a rubbing test using an eraser, it was confirmed that the film had a strength capable of enduring rubbing of 60 times with a load of 0.5 kg/cm$^2$. As a comparative example, a conventional solution of $Si(OR)_4$ disclosed in Japanese Patent Disclosure (Kokai) No. 61-118932 was coated on the faceplate by spraying and sintered at a temperature of 115° C. for ten minutes, thereby forming a film on the faceplate. The film on the outer surface of the faceplate which was obtained in this manner by the conventional method was resistant to rubbing of only 15 times when rubbing was performed with a load of 0.5 kg/cm$^2$. In order to obtain a film having the same strength as in Example 1 with the conventional method, sintering must be performed at a temperature of 210° C. for ten minutes. In this case, however, the surface of the faceplate was charged, and a sufficient antistatic effect could not be obtained.

EXAMPLE 2

A coating solution as in Example 1 was coated on the outer surface of the faceplate of a color cathode-ray tube as in Example 1 by a conventional dispensing method.

The resultant tube was sintered at a temperature of 115° C. for five minutes, thus forming an antistatic/anti-reflecting film having projections of average thickness of 0.1 μm. A sufficient antistatic effect was confirmed in Example 2 as well. A film strength capable of enduring rubbing of 300 times or more using an eraser with a load of 1 kg/cm$^2$ was obtained.

As is apparent from Examples 1 and 2 described above, according to the present invention, an antistatic-/anti-reflecting film having a sufficient adhering strength can be formed within a short period of time. As a result, the sintering conditions can be set less strict, the antistatic effect can be further enhanced, reflection of external light can be decreased, and workability can be greatly improved.

What is claimed is:

1. A method of manufacturing a cathode-ray tube, comprising the steps of:

(a) condensing and hydrolyzing two or more alkyl silicate monomers in an alcohol solution and in an average range of dimer to hexamer thereby forming, as a condensate a solution containing polyalkyl siloxane;

(b) coating said solution containing polyalkyl siloxane on a cathode-ray tube faceplate;

(c) continuing the condensing reaction of said solution containing polyalkyl siloxane to form a polyalkylsiloxane condensate; and (d) sintering the polyalkyl siloxane condensate of step (c) to convert same to $SiO_2$ dehydration and dealcoholation reactions, thereby forming an $SiO_2$ film on said faceplate.

* * * * *